United States Patent [19]

Einem et al.

[11] Patent Number: 4,529,187

[45] Date of Patent: Jul. 16, 1985

[54] TICKET MAGAZINE

[75] Inventors: Robert E. Einem, Glendale; Joseph A. Richards, Simi Valley, both of Calif.

[73] Assignee: International Telephone & Telegraph Corporation, New York, N.Y.

[21] Appl. No.: 419,606

[22] Filed: Sep. 17, 1982

[51] Int. Cl.[3] ..... B65H 3/06

[52] U.S. Cl. ..... 271/10; 271/110; 271/116; 271/121

[58] Field of Search ..... 271/110, 111, 116, 121, 271/124, 125, 10

[56] References Cited

U.S. PATENT DOCUMENTS

| | | | |
|---|---|---|---|
| 3,771,783 | 11/1973 | McInerny | 271/125 |
| 3,902,712 | 9/1975 | Dorer | 271/125 |
| 3,933,350 | 1/1976 | Mignano | 271/125 X |
| 3,991,998 | 11/1976 | Banz | 271/125 |
| 4,030,722 | 6/1977 | Irvine | 271/116 X |
| 4,083,555 | 4/1978 | Irvine | 271/116 X |

*Primary Examiner*—Richard A. Schacher

*Attorney, Agent, or Firm*—T. L. Peterson; J. S. Christopher

[57] ABSTRACT

A feed for ticket printers including a magazine having a frame, driven rollers to deliver the bottom one of a stack of tickets to a selection station, the selection station effectively permitting the withdrawal of the bottom ticket while restraining the remaining tickets, and a pair of compression rollers to pull the bottom ticket further through the selection station.

7 Claims, 3 Drawing Figures

TICKET MAGAZINE

BACKGROUND OF THE INVENTION

This invention relates to ticket magazines, and more particularly to means for selectively feeding tickets from a magazine into a printer or the like.

PRIOR ART STATEMENT

In the prior art, if the top ticket in a stack were to be fed to a ticket printer, the stack would have to be continually elevated. Apparatus to perform this function does not often operate well or at all.

SUMMARY OF THE INVENTION

In accordance with the feed of the present invention, the disadvantages of the prior art are overcome by providing a magazine to hold a stack of tickets including means to allow only the bottom ticket in the stack to be withdrawn therefrom.

BRIEF DESCRIPTION OF THE DRAWINGS

In the accompanying drawings which illustrate exemplary embodiments of the present invention.

DESCRIPTION OF THE PREFERRED EMBODIMENT

Figure 1:
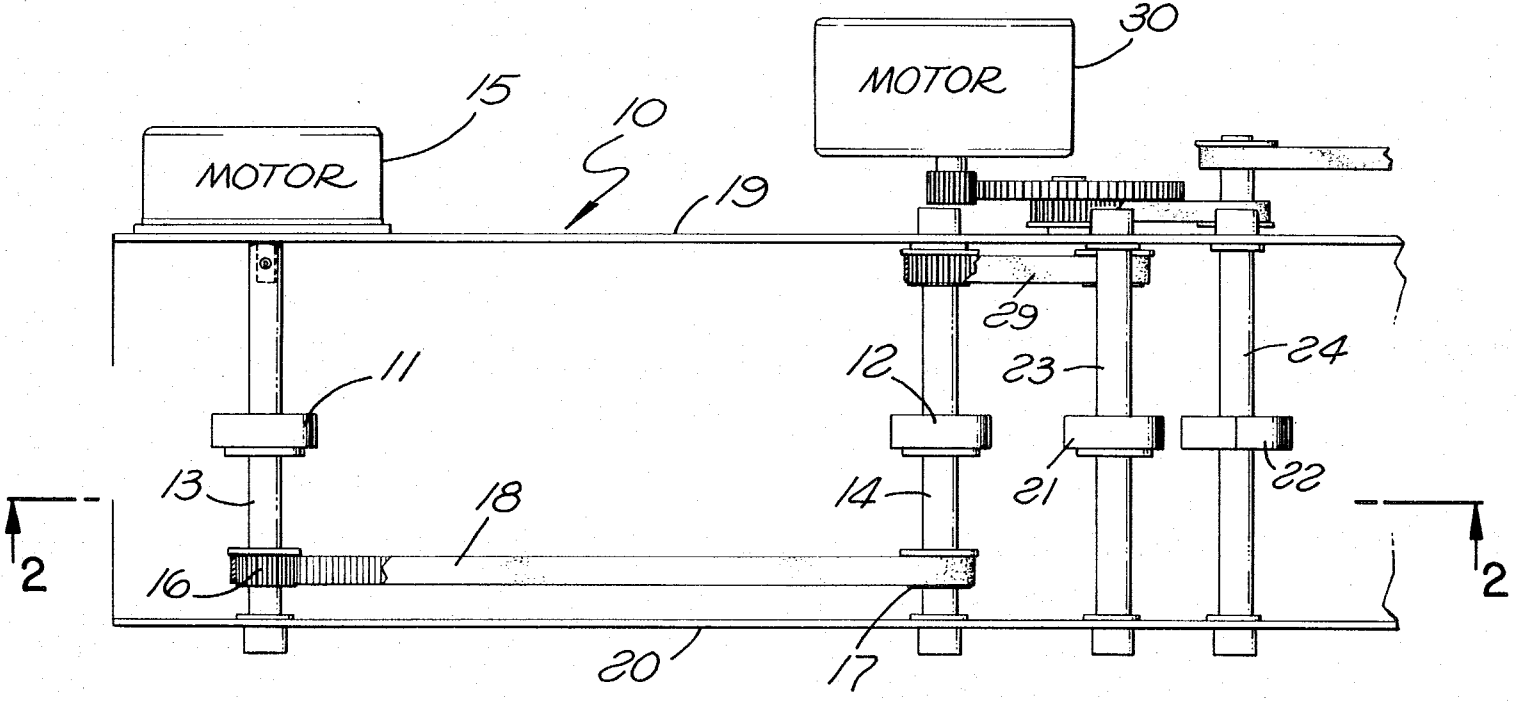
FIG. 1 is a top plan view of one embodiment of the present invention.

In the drawings in FIG. 1, a ticket magazine 10 is shown having parallel sidewalls 19 and 20 fixed relative to each other. Rollers 11 and 12 are driven on shafts 13 and 14, respectively, by a motor 15, gears 16 and 17, and a toothed belt 18.

A stack of tickets 32 (FIGS. 2 and 3) lays on those portions of rollers 11 and 12 visible in FIG. 1. The ticket at the bottom of the stack (in contact with rollers 11 and 12) is then moved to the right as viewed in FIG. 2.

In FIG. 1, note will be taken that roller-shaped bodies 21 and 22 are mounted on shafts 23 and 24, respectively. Shafts 23 and 24 are fixed relative to sidewalls 19 and 20. Body 21 is fixed relative to shaft 23. Body 22 is rotatable on shaft 24. Body 22 is an idler roller.

Roller-shaped bodies 25 and 26 are mounted underneath bodies 21 and 22, respectively, on shafts 27 and 28, respectively. Body 25 is a driven roller via belt 29.

Body 26 is also a driven roller. Body 26 is driven by a motor 30.

Bodies 11, 12, 21, 22, 25 and 26 are all friction idler or driven rollers having a rubber periphery (with the exception of body 21). Body 21 has an anti-friction surface body 31 (FIG. 3) and is fixed to shaft 23 as stated previously. Body 31 begins within angle A, where A may be 30 degrees.

Rollers 22 and 26 are spaced a distance less than the thickness of one ticket—perhaps less than 0.010 inch. The bottom ticket is withdrawn to the right in FIG. 2 faster by rollers 22 and 26 than by rollers 11, 12 and 25. Thus, rollers 11, 12 and 25 all have conventional overrunning clutches. See typical overrunning clutch 33 in roller 25 in FIG. 3.

Figure 3:
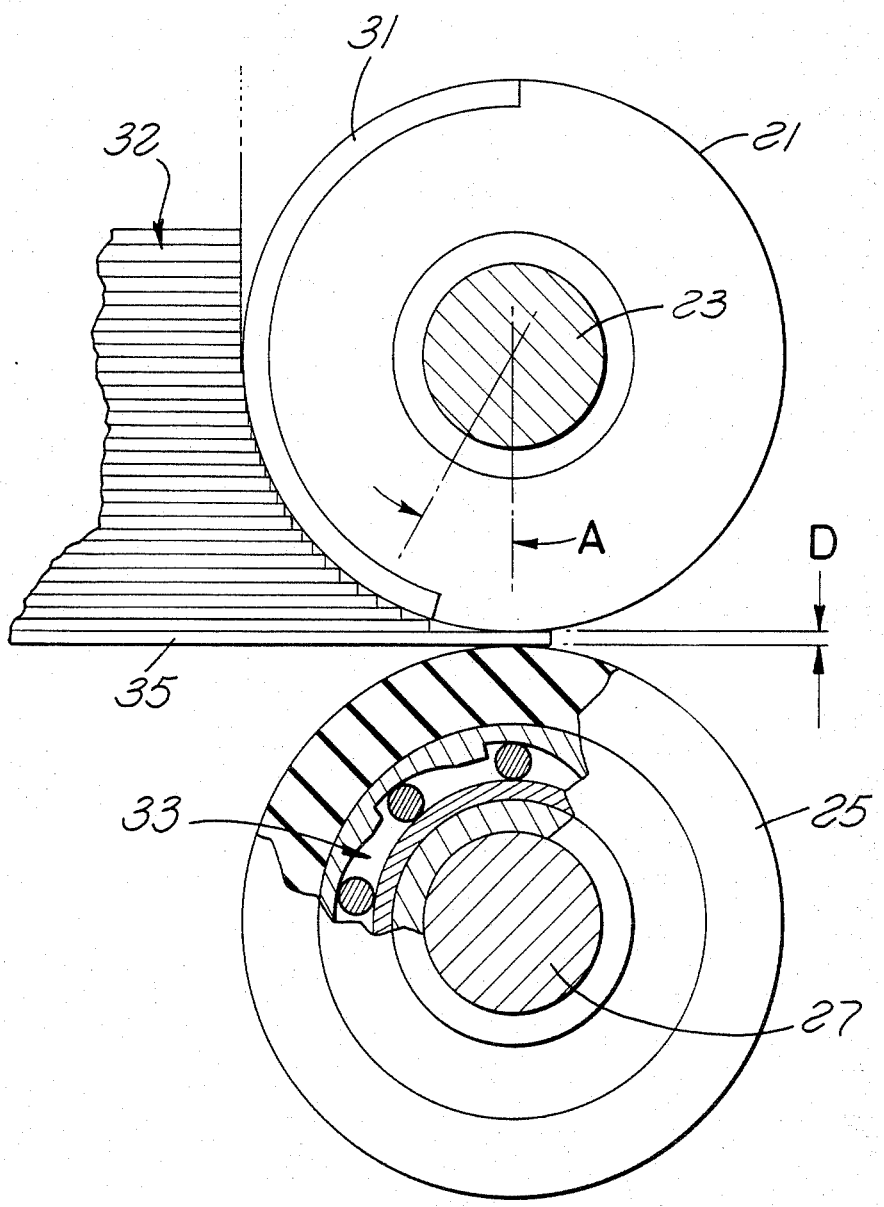
FIG. 3 is an enlarged longitudinal sectional view, partly in elevation, of a pair of roller-shaped bodies shown in FIG. 1.

In FIG. 3, note that bodies 21 and 25 are spaced apart a distance D which is larger than one ticket thickness and smaller than two ticket thicknesses.

Figure 2:
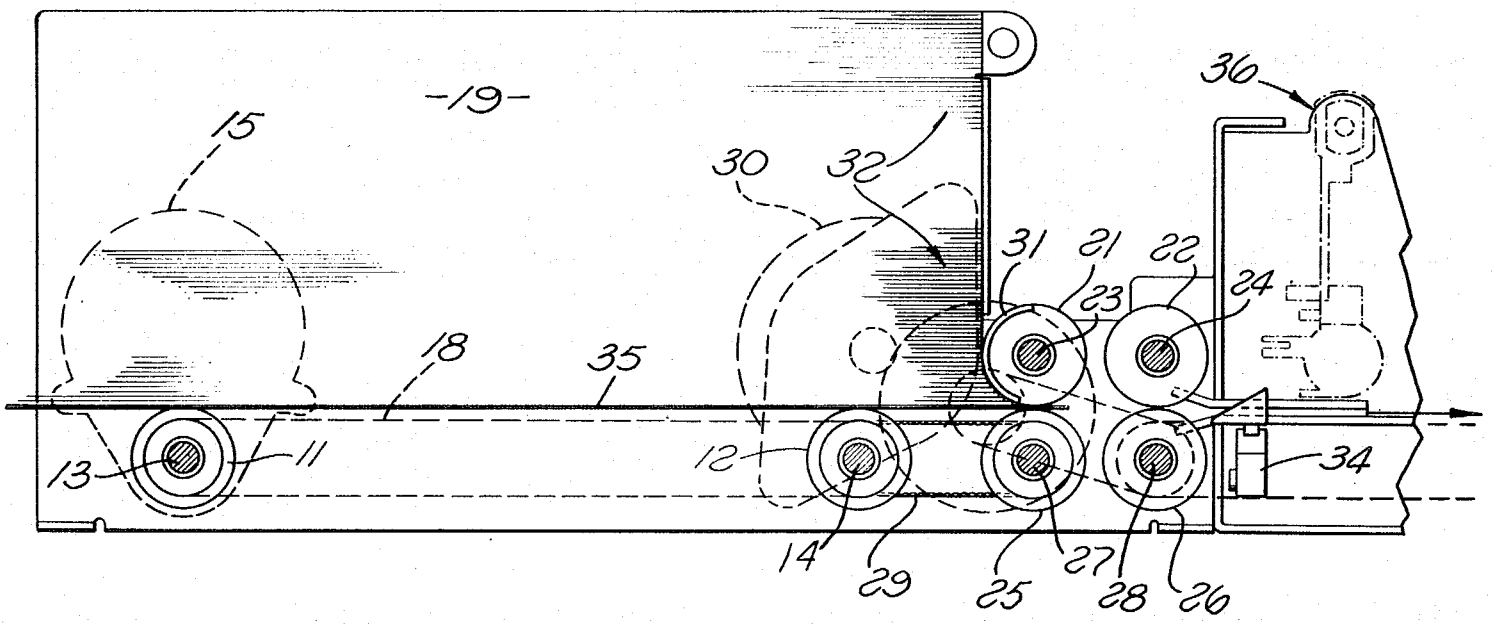
FIG. 2 is a longitudinal sectional view of the embodiment shown in FIG. 1 taken on the line 2—2 shown therein.

A conventional mechanical switch 34 is shown in FIG. 2 in a conventional ticket printer 36. Switch 34 is connected in series with motor 15 to disconnect the same when the right end of the bottom ticket, as shown in FIG. 2, is detected by switch 34. This prevents the next to last ticket in the stack from being driven to the right and from jamming the magazine when the same rests on roller 11.

Each of the bodies 11, 12, 21, 25, 22 and 26 of FIGS. 1, 2 and 3 is per se rubber and conventional. The same is true of motors 15 and 30.

Body 31 restrains movement of the ticket stack (except for bottom ticket 35) from moving to the right beyond the position shown in FIG. 3 where the same bear against body 31.

The ticket stack can move downwardly as viewed in FIG. 3 because body 31 is an anti-friction body.

OPERATION

In the operation of the ticket feed shown in FIGS. 1, 2 and 3, motor 15 rotates rollers 11, 12, and 25 via shaft 13 and belts 18 and 29. In this way bottom ticket 35 is pushed through the space D (FIG. 3) between bodies 21 and 25.

Driven roller 26 and idler roller 22 then press the right end of bottom ticket 35 therebetween and draw the same therebetween to a point past switch 34 to ticket printer 36. The ticket is then handled and printed in a conventional manner.

Switch 34 turns off motor 15 and allows rollers 11, 12 and 25 to free wheel until the left end of the bottom ticket 35 clears rollers 21 and 25.

All the while, body 31 restrains movement of the ticket stack (except for bottom ticket 35). All but bottom ticket 35 is thus prevented from moving to the right beyond the position shown in FIG. 3 where the same bear against body 31.

As stated previously, the ticket stack can move downwardly as viewed in FIG. 3 because body 31 is an anti-friction body.

As stated previously, the use of the present invention has advantages over the prior art. For example, if the top ticket of a stack is fed to a printer, the stack must be continually raised. The present invention thus is easier to operate in that the bottom ticket 35 is held positively and firmly against rollers 11 and 12 and the overrunning clutches allow the other driven rollers 25 and 26 to pull the bottom ticket positively forward.

Note will be taken that roller 21 is not necessarily a roller, but is preferably roller-shaped to accommodate tickets 32 and 35. The shape of roller 21 is not critical, but the surface against which the tickets bear is preferably cylindrical. A complete cylinder is not necessary for roller 21. Body 31 may be made of polytetrafluoroethylene (lubricous) or any other conventional material.

Roller 21 is equivalent to many other fixed members.

Motors 15 and 30 each may be a stepper motor and/or any other conventional unidirectional AC synchronous motor.

Many other equivalents are possible. For example, two rollers on one or more shafts is possible. A solid rubber shaft is also possible.

All of the rollers or bodies 11, 12, 21, 25, 22 and 26 may or may not have the same diameter. The tangential speeds of rollers 11, 12 and 25 are the same. The tangential speed of roller 26 is equal to or greater than that of, for example, roller 25.

What is claimed is:

1. A feed for a ticket printer or the like comprising: a magazine including a frame having parallel side members; a stack of tickets loaded contiguous to said side members; a first roller-shaped body to support a bottom ticket in said stack of tickets at a first end underneath the rear of said stack of tickets, and having a friction surface to move said bottom ticket forward in a direction parallel to said side members; a second roller-shaped body having a friction surface to support said bottom ticket beneath the same at a second end, said first and second roller-shaped bodies being mounted in positions fixed relative to said frame and in positions to rotate about respective parallel axes; and a first power means for rotating said first and second roller-shaped bodies in synchronism for moving said bottom ticket forward, wherein a third roller-shaped body and a fourth roller-shaped body are provided and are spaced vertically apart, said third roller-shaped body being located above said fourth roller-shaped body, said third and fourth roller-shaped bodies being spaced forward of said second roller-shaped body, said third roller-shaped body being fixed relative to said frame and wherein said fixed third roller-shaped body having an outer surface comprised of an anti-friction surface portion and a frictional surface portion, said anti-friction surface portion being located on said outer surface adjacent to said stack of tickets and within thirty mechanical degrees from a point on said outer surface of said fixed third roller-shaped body, said outer surface point being located on a vertical perpendicular line bisecting said fixed third roller-shaped body and being closest to said fourth roller-shaped body, said anti-friction surface portion contacting and restraining movement of said stack of tickets other than said bottom ticket in said direction parallel to said side members, said stack of tickets other than said bottom ticket being downwardly staggered along an outer circumference of said anti-friction surface portion, said third and fourth roller-shaped bodies being vertically spaced more than one ticket thickness and less than twice the thickness of a ticket with said frictional surface portion of said fixed third roller-shaped body facing said fourth roller-shaped body, said fourth roller-shaped body having a frictional surface to engage said bottom ticket with said anti-friction surface portion of said fixed third roller-shaped body isolating said stack of tickets other than said bottom ticket from said frictional surface of said fourth roller-shaped body until each ticket of said stack of tickets becomes said bottom ticket by gravitational force after each previous bottom ticket is engaged by said frictional surface of said fourth roller-shaped body, said frictional surface of said fourth roller-shaped body being driven by said first power means by a drive belt at a speed not less than that of a peripheral speed of said first and second roller-shaped bodies.

2. The invention as defined in claim 1, wherein a fifth friction roller-shaped body and a sixth friction roller-shaped body are provided, said fifth roller-shaped body being positioned vertically over said sixth roller-shaped body, said fifth and sixth roller-shaped bodies being positioned proximate one another to grip said bottom ticket, said first, second and fourth roller-shaped bodies each including an overrunning clutch, and further including a second power means for driving at least one of said fifth and sixth roller-shaped bodies for moving said bottom ticket in said direction parallel to said side members and at a velocity greater than the ticket velocity produced by said first and second roller-shaped bodies, said overrunning clutches permitting movement of said bottom ticket at a progressively larger velocity.

3. The invention as defined in claim 2, including a sensor to detect movement of a forward end of said bottom ticket past a predetermined point forward of said third and fourth roller-shaped bodies, said sensor de-energizing said first power means when said bottom ticket passes said predetermined point.

4. A feed for a ticket printer or the like comprising: a magazine including a frame having parallel side members; a stack of tickets loaded contiguous to said side members; a first roller-shaped body to support a bottom ticket in said stack of tickets at a first end underneath the rear of said stack of tickets, and having a friction surface to move said bottom ticket forward in a direction parallel to said side members; a second roller-shaped body having a friction surface to support said bottom ticket beneath the same at a second end, said first and second roller-shaped bodies being mounted in positions fixed relative to said frame and in positions to rotate about respective parallel axes; and a first power means for rotating said first and second roller-shaped bodies in synchronism for moving said bottom ticket forward, wherein a third friction roller-shaped body and a fourth friction roller-shaped body are provided, said third roller-shaped body being positioned vertically over said fourth roller-shaped body, said third and fourth roller-shaped bodies being positioned proximate one another to grip said bottom ticket, said first and second roller-shaped bodies each including an overrunning clutch, and further including a second power means for driving at least one of said third and fourth roller-shaped bodies for moving said bottom ticket in said direction parallel to said side members and at a velocity greater than the ticket velocity produced by said first and second roller-shaped bodies, said overrunning clutches permitting movement of said bottom ticket at a progressively larger velocity.

5. The invention as defined in claim 4, including a sensor to detect movement of a forward end of said bottom ticket past a predetermined point forward of said third and fourth roller-shaped bodies, said sensor de-energizing said first power means when said bottom ticket passes said predetermined point.

6. A feed for a ticket printer or the like comprising: a first vertically spaced roller-shaped body and a second vertically spaced roller-shaped body, said first roller-shaped body being held in a fixed position; means to rotate said second roller-shaped body; means to support a vertical stack or tickets on a first side of said first roller-shaped body; means to urge said stack of tickets toward said inlet and second roller-shaped bodies, said first and second roller-shaped bodies being oriented and spaced apart a ticket thickness to pass a bottom ticket of said stack of tickets, motion of the remainder of said stack of tickets being blocked by said first roller-shaped body, wherein said fixed first roller-shaped body having an outer surface comprised of an anti-friction surface portion and a frictional surface portion, said anti-friction surface portion being located on said first side of said fixed first roller-shaped body on said outer surface adjacent to said stack of tickets and within thirty mechanical degrees from a point on said outer surface of said fixed first roller-shaped body, said outer surface point being located on a vertical perpendicular line bisecting said fixed first roller-shaped body and being closest to said second roller-shaped body, said anti-friction surface portion contacting and restraining movement of said stack of tickets other than said bottom ticket in a direction parallel to said means urging said stack of tickets toward said first and second roller-shaped bodies, said stack of tickets other than said bottom ticket being downwardly staggered along a outer circumference of said anti-friction surface portion, said frictional surface portion of said fixed first roller-shaped body facing said second roller-shaped body, said second roller-shaped body having a frictional surface to engage said bottom ticket with said anti-friction surface portion of said fixed first roller-shaped body isolating said stack of tickets other than said bottom ticket from said frictional surface of said second roller-shaped body until each ticket of said stack of tickets becomes said bottom ticket by gravitational force after each previous bottom ticket is engaged by said frictional surface of said second roller-shaped body, said frictional surface of said second roller-shaped body being driven by said rotating means.

7. The invention as defined in claim 6, wherein said second body has an overrunning clutch.

* * * * *